US006761464B2

(12) United States Patent
Hsien

(10) Patent No.: US 6,761,464 B2
(45) Date of Patent: Jul. 13, 2004

(54) SEALING DEVICE FOR FLASHLIGHTS

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 50 days.

(21) Appl. No.: 10/294,641

(22) Filed: Nov. 15, 2002

(65) Prior Publication Data

US 2004/0095753 A1 May 20, 2004

(51) Int. Cl.[7] ..... F21L 4/00
(52) U.S. Cl. ..... 362/158; 362/202
(58) Field of Search ..... 362/158, 202, 362/208, 267

(56) References Cited

U.S. PATENT DOCUMENTS 4,527,223 A * 7/1985 Maglica ..... 362/158
5,021,934 A * 6/1991 Hou ..... 362/158
5,349,506 A * 9/1994 Maglica ..... 362/158
6,158,873 A * 12/2000 Griffiths ..... 362/158
6,283,611 B1 * 9/2001 Sharrah et al. ..... 362/158

* cited by examiner

*Primary Examiner*—Stephen F Husar
(74) *Attorney, Agent, or Firm*—Rosenberg, Klein & Lee

(57) ABSTRACT

A flashlight includes a tubular body with a power supply device received therein via an open end of the body. A cap is connected to the open end and has a groove defined in an inner periphery thereof A bulb and reflection disk assembly is engaged with the cap and a lens is engaged with the cap. A seal is engaged with the groove and mounted to an outer periphery of the open end of the tubular body. The seal has a dumb-bell shaped cross section.

5 Claims, 4 Drawing Sheets

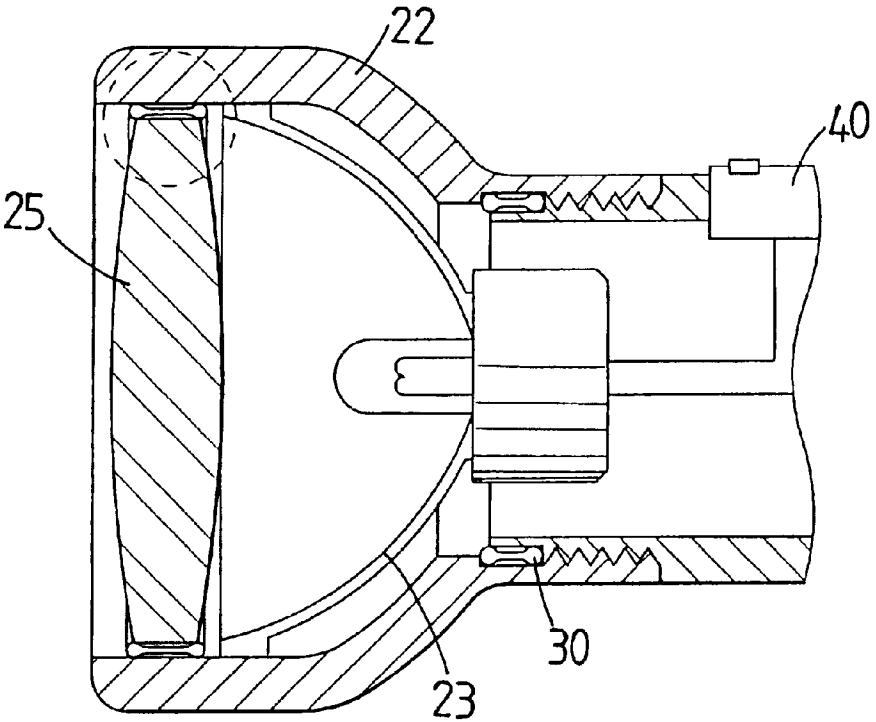
FIG. 4
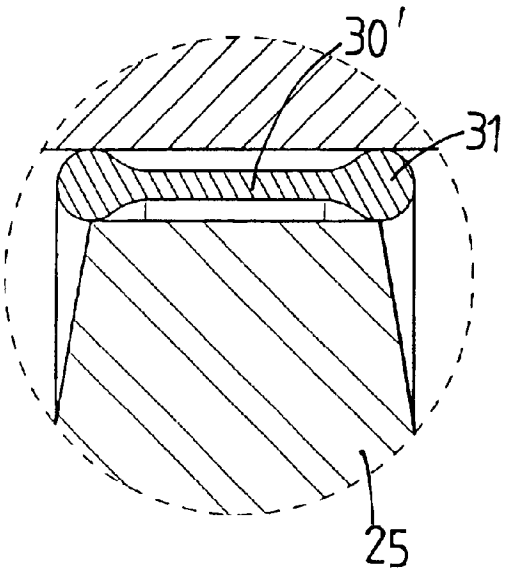

SEALING DEVICE FOR FLASHLIGHTS

FIELD OF THE INVENTION

The present invention relates to a flashlight that has two seals respectively engaged between the cap and the tubular body, and between the lens and the cap. Each seal has a dumb-bell shaped cross section.

BACKGROUND OF THE INVENTION

A conventional flashlight is shown in FIG. 1 generally includes a body 11 with an open end 14 and a threaded section 12 is defined in an outer periphery of the open end 14. Two batteries 15 are received in the body 11 and a bulb assembly 10 is received in the open end 14 and electrically connected to the battery 15. A cap 13 with a rotatable collar 16 is threadedly connected to the threaded section 12. The flashlight has no proper sealing feature so that moisture, rain drop, dust or sands may enter the bulb assembly 10 via the gaps between threaded section 12 and the cap 13. The dust or sands make the cap 13 to be stocked and difficult to be rotated.

The present invention intends to provide a sealing device for a flashlight and includes a seal that has dumb-bell shaped cross section and the seal is clamped between the cap and the body of the flashlight so as to prevent rain drop, dust and sands entering the threads.

SUMMARY OF THE INVENTION

In accordance with one aspect of the present invention, there is provided a flashlight which comprises a tubular body having an open end so as to receive a power supply device via the open end. A cap is connected to the open end and has a groove defined in an inner periphery thereof A bulb and reflection disk assembly is engaged with the cap and a lens is engaged with the cap. A seal is engaged with the groove and mounted to an outer periphery of the open end of the tubular body.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 4 shows that a length between the two enlarged portions of the seal is longer than a width of the periphery of the lens.

DETAILED DESCRIPTION OF THE PREFERRED EMBODIMENT

Figure 1:
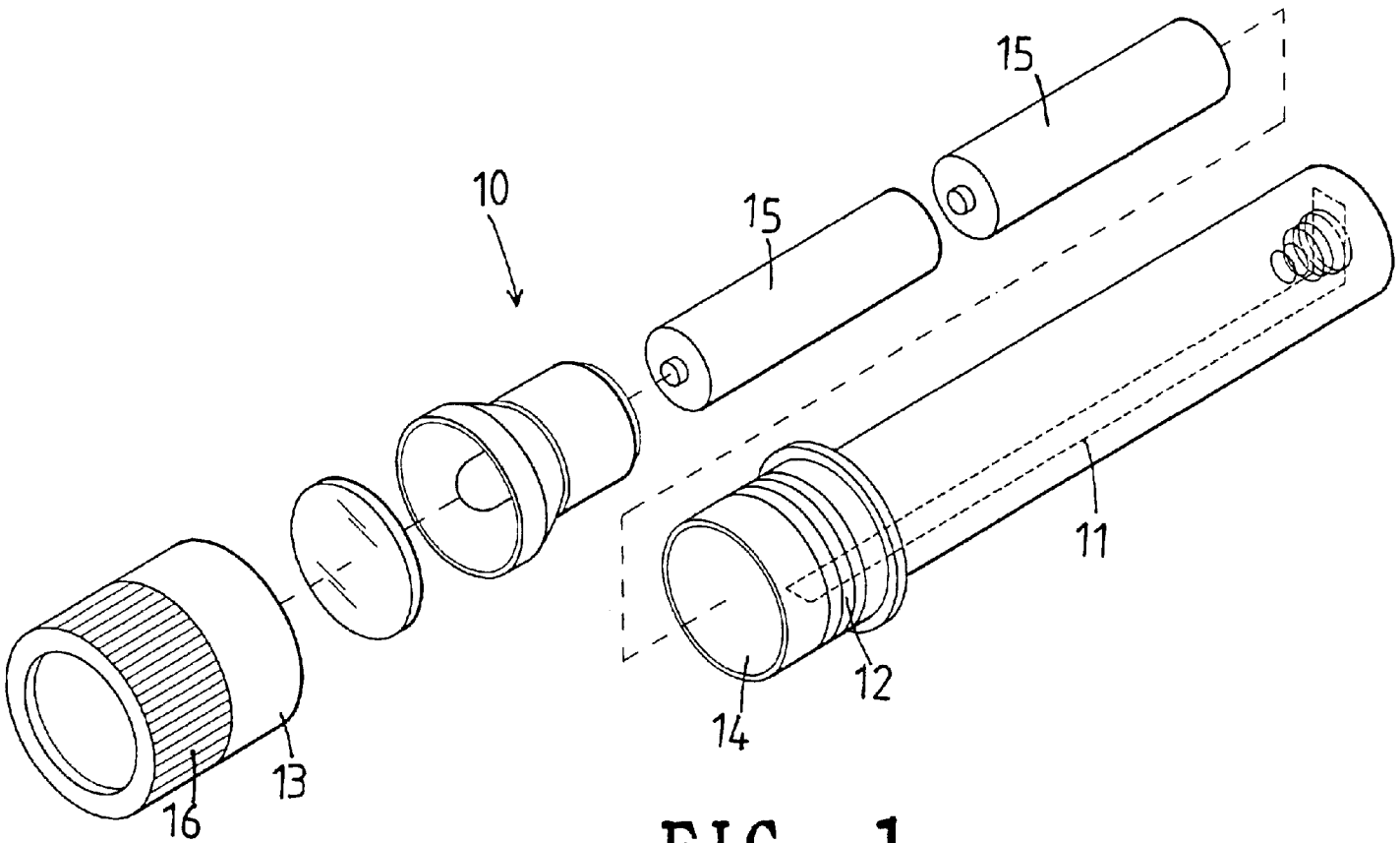
FIG. 1 PRIOR ART
FIG. 1 is an exploded view to show a conventional flashlight.
Figure 2:
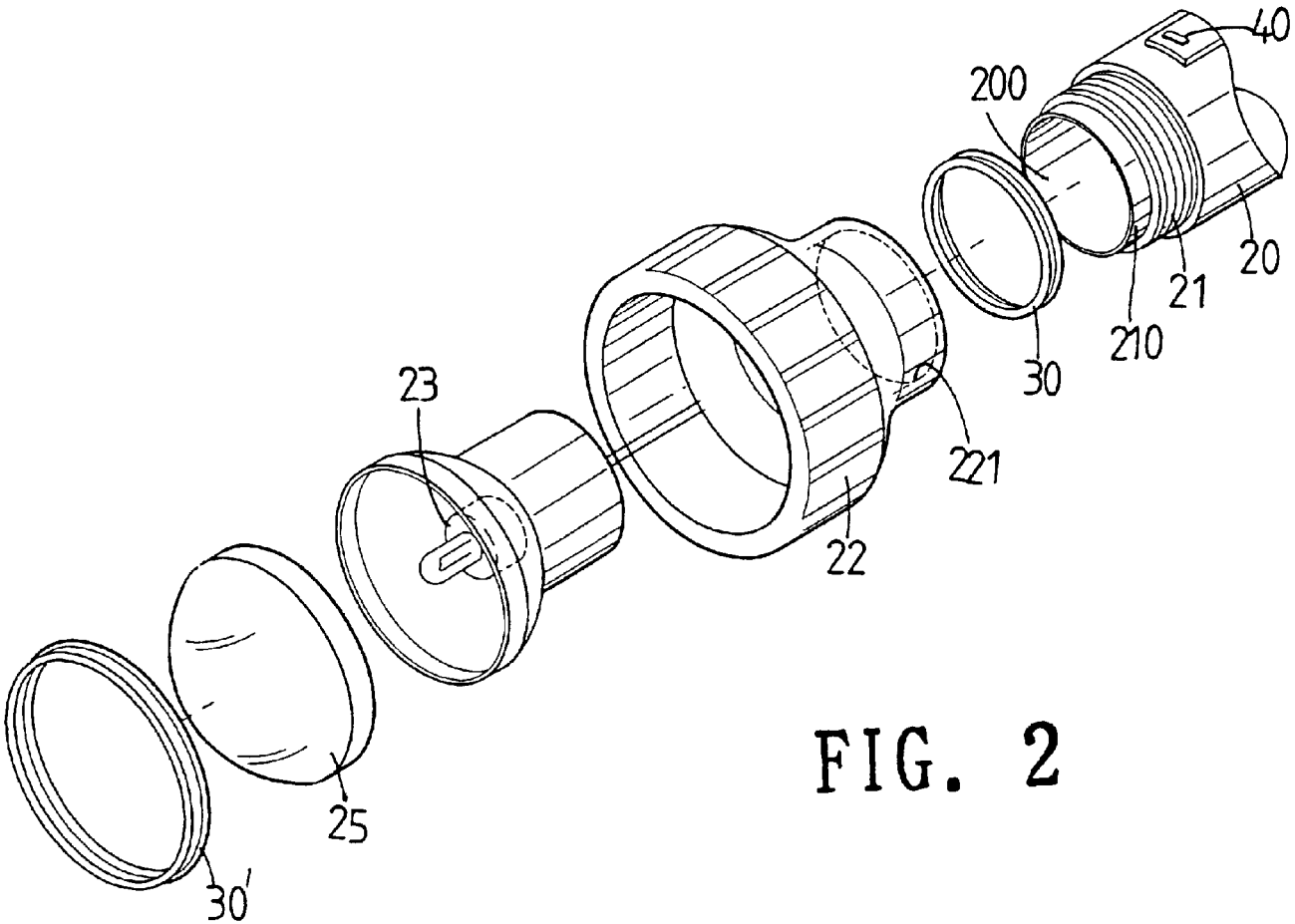
FIG. 2 is an exploded view to show the flashlight of the present invention.
Figure 3:
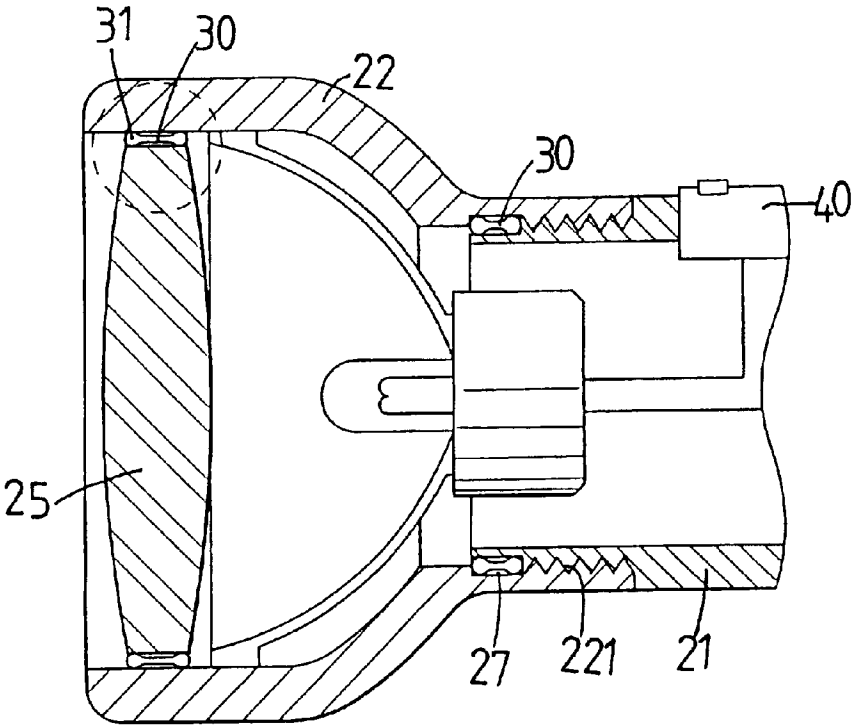
FIG. 3 is a cross sectional view to show two seals are installed in the flashlight of the present invention.
Figure 3:
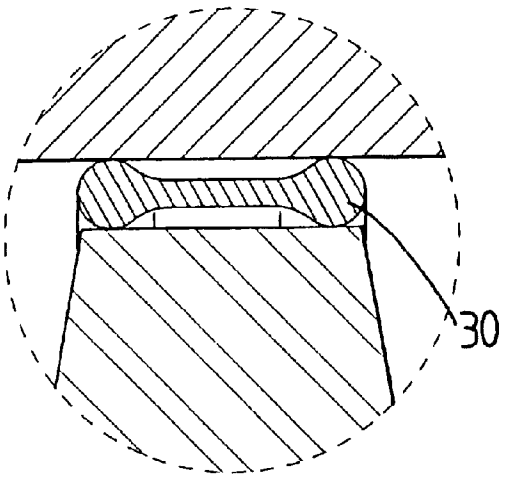

Referring to FIGS. 2 and 3, the flashlight of the present invention comprises a tubular body 20 having an open end 200 so that a power supply device such as batteries (not shown) is received in the tubular body 20 via the open end 200. A threaded section 21 and a plain section 210 are defined in an outer periphery of the open end 200.

A cap 22 includes a neck portion which has a threaded inner periphery 221 and a groove 27 is defined in an inner periphery of the neck portion. The cap 22 is connected to the open end 200 by threadedly engaging the threaded inner periphery 221 with the threaded section 21 on the body 20.

A bulb and reflection disk assembly 23 is engaged with the cap 22 and a lens 25 engaged with the cap 22. The bulb and reflection disk assembly 23 is electrically connected to the batteries and a switch 40 on the body 40 so that the bulb in the bulb and reflection disk assembly 23 lights up by operating the switch 40.

A seal 30 having a dumb-bell shaped cross section is engaged with the groove 27 and mounted to the plain section 210 of the open end 200 of the tubular body 20. The seal 30 effectively prevents rain drop, sand or dust from entering the gaps between the threaded section 21 and the threaded inner periphery 221. Another seal 30' is mounted on a periphery of the lens 25 and squeezed between the inner periphery of the cap and the periphery of the lens 25.

Referring to FIG. 4, the seal 40' includes two enlarged portions 31 on two ends of the cross section thereof and a length between the two enlarged portions 31 is longer than a width of the periphery of the lens 25. This arrangement ensures that no rain drop, sands, or dust can enter the cap 22 from the gap between the lens 25 and the cap 22.

While we have shown and described the embodiment in accordance with the present invention, it should be clear to those skilled in the art that embodiments may be made without departing from the scope of the invention.

What is claimed is:

1. A flashlight comprising:

a tubular body having an open end so as to be adapted to receive a power supply device via the open end, a cap connected to the open end, the cap having a groove defined in an inner periphery thereof;

a bulb and reflection disk assembly engaged with the cap and a lens engaged with the cap, and a seal engaged with the groove and mounted to an outer periphery of the open end of the tubular body.

2. The flashlight as claimed in claim 1 wherein the cap has a neck portion which has a threaded inner periphery and the groove is defined in an inner periphery of the neck portion, the outer periphery of the open end of the tubular body has a threaded section and a plain section, the seal mounted to the plain section.

3. The flashlight as claimed in claim 1 wherein the seal has a dumb-bell shaped cross section.

4. The flashlight as claimed in claim 1 further comprising another seal which is mounted on a periphery of the lens and squeezed between the inner periphery of the cap and the periphery of the lens.

5. The flashlight as claimed in claim 4 wherein the seal includes two enlarged portions on two ends of a cross section thereof and a length between the two enlarged portions is longer than a width of the periphery of the lens.

* * * * *